US005900900A

United States Patent [19]

Hotta et al.

[11] Patent Number: 5,900,900

[45] Date of Patent: May 4, 1999

[54] IMAGE RECORDING METHOD USING REVERSIBLE THERMOSENSITIVE RECORDING MATERIAL AND IMAGE DISPLAY APPARATUS USING THE SAME

[75] Inventors: Yoshihiko Hotta, Mishima; Yukio Konagaya, Shizuoka-ken; Kunichika Morohoshi, Numazu; Makoto Kawaguchi, Shizuoka-ken; Toru Nogiwa, Numazu; Akira Suzuki, Mishima; Yusuke Takeda, Yokohama, all of Japan

[73] Assignee: Ricoh Company, Ltd., Tokyo, Japan

[21] Appl. No.: 08/889,063

[22] Filed: Jul. 7, 1997

Related U.S. Application Data

[63] Continuation of application No. 08/312,160, Sep. 23, 1994, abandoned, which is a continuation of application No. 07/818,910, Jan. 10, 1992, abandoned.

[30] Foreign Application Priority Data

Jan. 11, 1991 [JP] Japan ..... 3-013699
Jan. 8, 1992 [JP] Japan ..... 4-019589

[51] Int. Cl.[6] ..... B41J 2/365

[52] U.S. Cl. ..... 347/194; 347/189

[58] Field of Search ..... 347/189, 194, 347/211; 400/120.14

[56] References Cited

U.S. PATENT DOCUMENTS

| | | | |
|---|---|---|---|
| 4,268,413 | 5/1981 | Dabisch | 252/408 |
| 4,594,501 | 6/1986 | Culley et al. | 347/194 |
| 4,675,695 | 6/1987 | Samuel | 347/194 |
| 4,695,528 | 9/1987 | Dabisch et al. | 430/290 |
| 4,871,609 | 10/1989 | Suzuki et al. | 428/195 |
| 4,917,948 | 4/1990 | Hotta | 428/335 |
| 4,965,591 | 10/1990 | Kurabayashi et al. | 346/135.1 |
| 4,977,030 | 12/1990 | Hotta et al. | 428/447 |
| 5,017,421 | 5/1991 | Hotta et al. | 428/216 |

(List continued on next page.)

FOREIGN PATENT DOCUMENTS

| | | | |
|---|---|---|---|
| 62-152550 | 6/1987 | Japan . | |
| 0246014 | 10/1987 | Japan | 359/86 |
| 264014 | 10/1987 | Japan . | |
| 63-14754 | 1/1988 | Japan . | |
| 0265228 | 11/1988 | Japan | 359/86 |
| 0267917 | 11/1988 | Japan | 359/86 |
| 0313134 | 12/1988 | Japan | 359/86 |
| 0014079 | 1/1989 | Japan . | |
| 1-140109 | 5/1989 | Japan . | |
| 0188293 | 7/1990 | Japan . | |
| 0188294 | 7/1990 | Japan . | |
| 2-414438 | 12/1990 | Japan . | |

*Primary Examiner*—Huan Tran
*Attorney, Agent, or Firm*—Oblon, Spivak, McClelland, Maier & Neustadt, P.C.

[57] ABSTRACT

An image recording method using a reversible thermosensitive recording material which is capable of assuming a transparent state when heated to a first temperature which is above room temperature, and a colored state when heated to a second temperature which is higher than the first temperature and then cooled, and a heating element, including the step of applying energy to the heating element for generating heat in such a manner as to form each picture element of an image to be formed in the recording material by a plurality of energy pulses applied thereto. An image recording apparatus for this image recording method is also described, which includes a pulse division device for dividing the energy to be applied to the heating element into the plurality of energy pulses, an ambient temperature measurement device for measuring the ambient temperature around the recording material, and a pulse-generation timing adjustment device for adjusting the timing for the generation of the plurality of energy pulses.

2 Claims, 8 Drawing Sheets

U.S. PATENT DOCUMENTS

| | | | |
|---|---|---|---|
| 5,025,267 | 6/1991 | Schofield et al. | 347/194 |
| 5,066,107 | 11/1991 | Yoshinaga et al. | 359/45 |
| 5,085,934 | 2/1992 | Hotta et al. | 428/335 |
| 5,103,332 | 4/1992 | Kaneko | 359/98 |
| 5,108,980 | 4/1992 | Hotta et al. | 503/226 |
| 5,110,698 | 5/1992 | Hara et al. | 359/45 |
| 5,116,803 | 5/1992 | Hotta et al. | 503/208 |
| 5,157,011 | 10/1992 | Okabe et al. | 503/201 |
| 5,158,924 | 10/1992 | Konagaya et al. | 503/201 |
| 5,219,820 | 6/1993 | Morohoshi et al. | 503/204 |
| 5,278,128 | 1/1994 | Hotta et al. | 503/207 |
| 5,283,220 | 2/1994 | Kawaguchi et al. | 503/200 |
| 5,308,823 | 5/1994 | Hotta et al. | 503/209 |
| 5,310,718 | 5/1994 | Amano et al. | 503/201 |

FIG. 9(c-1)
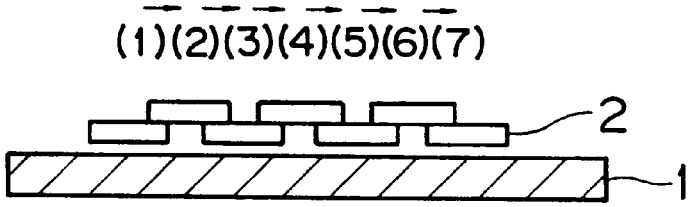
FIG. 9(c-2)
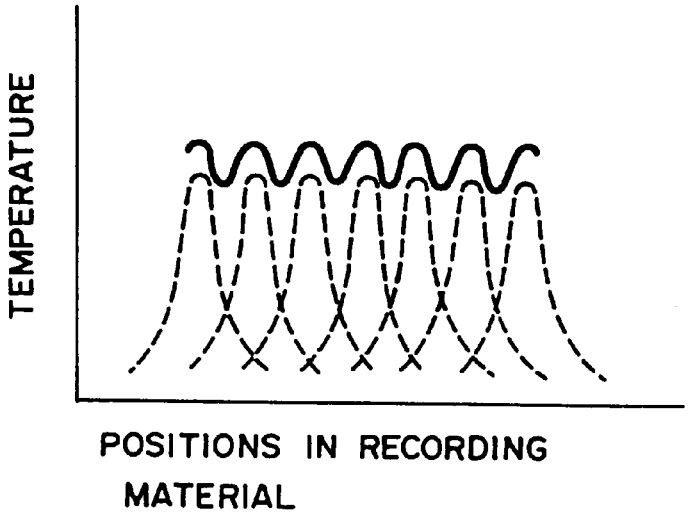

IMAGE RECORDING METHOD USING REVERSIBLE THERMOSENSITIVE RECORDING MATERIAL AND IMAGE DISPLAY APPARATUS USING THE SAME

This application is a Continuation of application Ser. No. 08/312,160, filed on Sep. 23, 1994, now abandoned, which is a Continuation of application Ser. No. 07/818,910, filed Jan. 10, 1992, abandoned.

BACKGROUND OF THE INVENTION

Field of the Invention

The present invention relates to an image recording method using a reversible thermosensitive recording material which is capable of assuming a transparent state when heated to a first temperature which is above room temperature, and of assuming a colored state when heated to a second temperature which is higher than the first temperature and then cooled, in which images are formed by applying a plurality of energy pulses to the recording material through a heating element in such a manner as to form each picture element of each image by the application of the plurality of energy pulses to the recording material. The present invention also relates to an image recording apparatus for carrying out this image recording method.

DISCUSSION OF BACKGROUND

Recently attention has been paid to a reversible thermosensitive recording material capable of temporarily recording images thereon and erasing the same therefrom when such images become unnecessary. As representative examples of this kind of reversible thermosensitive recording material, there are conventionally known reversible thermosensitive recording materials in which an organic low-molecular-weight material such as a higher fatty acid is dispersed in a matrix resin such as polyvinyl-chloride-based resin as disclosed in Japanese Laid-Open Patent Applications 54-119377 and 55-154198.

However, with these recording materials, it is difficult to control the temperature to make a milky white opaque portion transparent or to form a transparent image against a milky white opaque background because the temperature interval in which the opaque portion can be made transparent is as narrow as 2 to 4° C.

The applicants of the present invention have previously proposed reversible thermosensitive recording materials having a broadened temperature interval in which the milky white opaque portion of the recording material can be made transparent by using particular materials for the recording materials as disclosed in Japanese Laid-Open Patent applications 63-39378, 63-178079, and 63-14754.

These recording materials can attain their intended object of broadening the temperature interval. However, it is occasionally difficult to obtain a transparent state with the application of heat for a short period of time, for instance, by a thermal head. In other words, a transparent image cannot be easily formed on a milky white opaque background.

Moreover, when a milky white opaque state is formed in the recording materials by the application of heat thereto for a short period of time by a thermal head, the temperature of the recording materials has to be raised so high that the recording materials are caused to deteriorate and the surfaces thereof become uneven while in use due to the high temperature.

SUMMARY OF THE INVENTION

It is therefore a first object of the present invention to provide an image recording method using a reversible thermosensitive recording material, which is free from the above-mentioned conventional shortcomings, and capable of yielding a uniformly colored or transparent state with a transparent or colored background even when the temperature interval for the formation of the image is short, and capable of attaining uniform heat application to the recording material even when heat is applied for a short period of time by a heating element such as a thermal head, and also capable of improving the durability of the recording material even when image formation and erasure are repeated. In the present invention, the colored state includes not only a colored state such as a red or blue colored state, but also a milky white opaque state.

A second object of the present invention is to provide an image recording apparatus capable of carrying out the above-mentioned image recording method.

The first object of the present invention is achieved by an image recording method using (a) a reversible thermosensitive recording material which is capable of developing a colored state when heated to a first temperature which is above room temperature, and a colored state when heated to a second temperature which is higher than said first temperature and then cooled, and (b) a heating element, comprising the step of applying energy to the heating element for generating heat in such a manner as to form each picture element of an image to be formed in the recording material by the application of a plurality of energy pulses.

In the above image recording method, the timing for the generation of the energy pulses can be adjusted in accordance with the ambient temperature around the recording material. Furthermore, the amount of the energy applied to the heating element can also be adjusted in accordance with the ambient temperature.

The second object of the present invention is achieved by an image recording apparatus for carrying out the above image recording method comprising a pulse division means for dividing the energy to be applied to the heating element into a plurality of energy pulses, an ambient temperature measurement means for measuring the ambient temperature around the recording material, and a pulse-generation timing adjustment means for adjusting the timing for the generation of the plurality of energy pulses.

In the above image recording apparatus, the pulse-generation timing adjustment means may adjust the timing for the generation of the plurality of energy pulses in accordance with the ambient temperature. The image recording apparatus may further comprise an energy application adjustment means for adjusting the amount of the energy applied to the heating element in accordance with the above-mentioned ambient temperature.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Reversible thermosensitive recording materials for use in the image recording method according to the present invention change the properties of their colored states such as transparency, opaqueness, color tone, and optical absorption depending upon the temperature thereof.

Examples of this type of recording material are a reversible thermosensitive recording material which assumes a transparent state at a first temperature and a milky white opaque state at a second temperature as disclosed in Japanese Laid-Open Patent Application 55-154198; a reversible thermosensitive recording material which assumes a milky white opaque state at a first temperature and a transparent state at a second temperature as disclosed in Japanese Laid-Open Patent Application 3-169590; reversible thermosensitive coloring recording materials which develop a color such as black, red or blue at a first temperature and decolorize the developed color at a second temperature as disclosed in Japanese Laid-Open Patent Applications 2-188293, and 2-188294, and a reversible thermosensitive coloring recording material which develops a color at a second temperature and decolorizes the developed color at a first temperature as disclosed in Japanese Patent Application 2-414438.

In particular, it is preferable to employ a reversible thermosensitive recording material which comprises an organic low-molecular-weight material and a matrix resin in which the organic low-molecular-weight material is dispersed, and which assumes a transparent state at a first temperature and a milky white opaque state at a second temperature. This is because this type of recording material has excellent thermal sensitivity and durability.

It is considered that the transparent state and the milky white opaque state of the recording material are formed on the following principle:

(i) In the transparent state, the organic low-molecular-weight material dispersed in the matrix resin consists of relatively large crystals, so that the light which enters the crystals from one side passes therethrough to the opposite side, without being scattered, thus the reversible thermosensitive recording material appears transparent.

(ii) In the milky white opaque state, the organic low-molecular-weight material is composed of polycrystals consisting of numerous small crystals, with the crystallographic axes pointed to various directions, so that the light which enters the recording layer is scattered a number of times on the interfaces of the crystals of the low-molecular-weight material. As a result, the thermosensitive recording layer becomes opaque in a milky white color.

The transition of the state of the reversible thermosensitive recording layer depending on the temperature thereof will now be explained by referring to FIG. 1.

Figure 1:
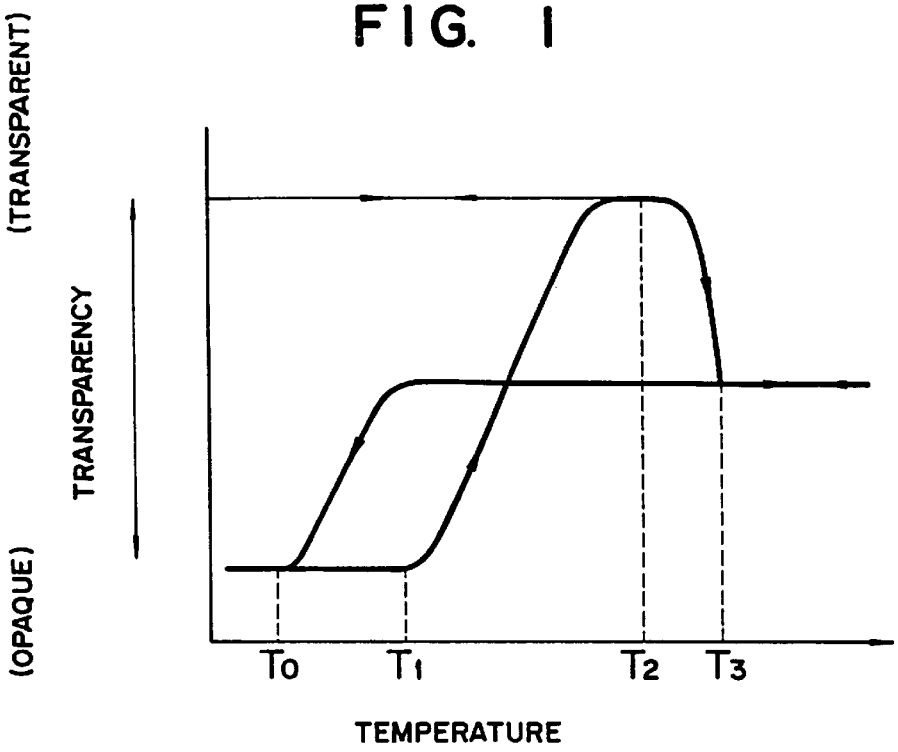
FIG. 1 is a diagram showing the changes in the transparency of a reversible thermosensitive recording material for use in the present invention, depending upon the temperature thereof.

In FIG. 1, it is supposed that the reversible thermosensitive recording material comprising a matrix resin and an organic low-molecular-weight material dispersed in the matrix resin is initially in a maximum milky white opaque state at room temperature $T_0$ or below. When the recording material is heated to a first temperature $T_2$, the recording material becomes transparent and reaches a maximum transparent state. Even if the recording material which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording material in the maximum transparent state is further heated to a second temperature $T_3$ or more, it assumes a half-transparent state which is between the maximum transparent state and the maximum milky white opaque state. When the recording material in the half-transparent state at the second temperature $T_3$ or more is cooled to room temperature $T_0$ or below, the recording material returns to the original maximum milky white opaque state, without passing through any transparent state again. It is considered that this is because the organic low-molecular-weight material is melted when heated to the second temperature $T_3$ or above, and the polycrystals of the organic low-molecular-weight material grow and separate out when it is cooled. If the recording material in the milky white opaque state is heated to any temperature between temperature $T_1$ and the first temperature $T_2$, and then cooled to a temperature below the room temperature $T_0$, the recording material assumes an intermediate state between the transparent state and the milky white opaque state.

When the recording material in the transparent state at room temperature $T_0$ is again heated to the second temperature $T_3$ or above, and then cooled to room temperature $T_0$, the recording material returns to the milky white opaque state. Thus, the reversible thermosensitive recording material for use in the present invention can assume the milky white maximum opaque state, the maximum transparent state and the intermediate state between the aforementioned two states at room temperature.

Therefore, a milky white opaque image can be obtained against a transparent background, or a transparent image against a milky white opaque background by the selective application of thermal energy to the reversible thermosensitive recording material. Furthermore, such image formation and erasure can be repeated as desired.

When a colored sheet is placed behind the reversible thermosensitive recording layer of the recording material, the colored image can be obtained against the white opaque background or the white opaque image can be obtained against the colored background.

In the case where the reversible thermosensitive recording material for use in the present invention is projected using an OHP (Over-Head Projector), a milky white opaque portion in the recording material appears dark and a transparent portion in the recording material, through which the light passes, becomes a bright portion on the screen.

Figure 2:
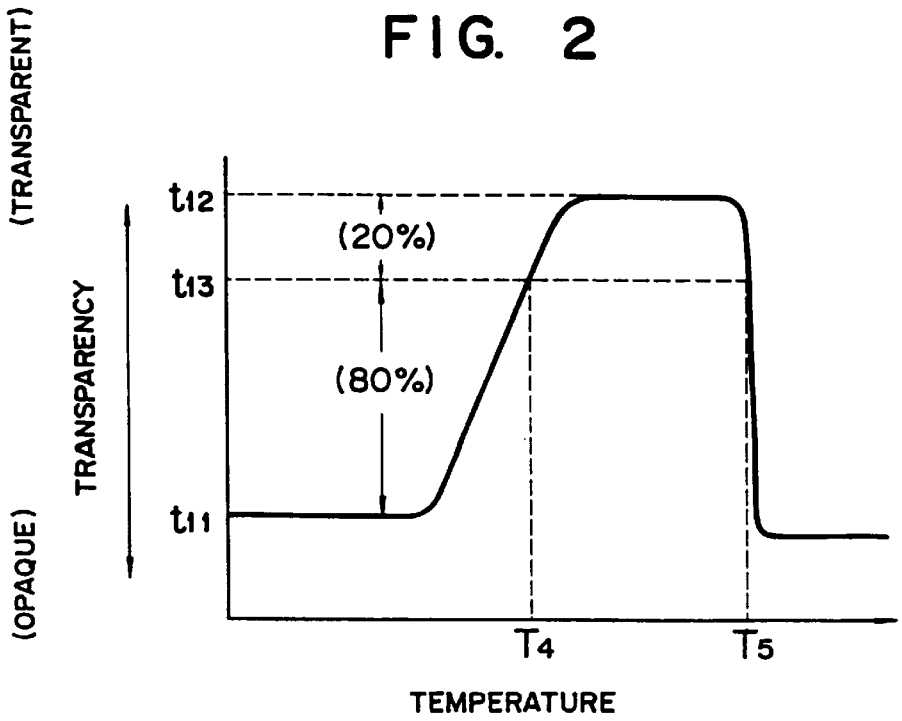
FIG. 2 is a diagram in explanation of the degree of the transparency of the reversible thermosensitive recording material for use in the present invention.

FIG. 2 shows the transparencies of the reversible thermosensitive recording material when the recording material in the white opaque state is heated to temperatures between $T_1$ to $T_3$ shown in FIG. 1 and cooled to temperature at $T_0$ or less to measure the transparency at each temperature to obtain a minimum transparency or a maximum opaqueness and a maximum transparency or a minimum opaqueness. The thus obtained minimum transparency is defined as transparency $t_{11}$, and the maximum transparency is defined as transparency $t_{12}$ as shown in FIG. 2. A value of transparency is then obtained by adding (a) 80% of the value of the difference between the minimum transparency $t_{11}$ and the maximum transparency $t_{12}$ calculated from the minimum transparency $t_{11}$ side to (b) the value of the minimum transparency $t_{11}$. The thus obtained value of transparency is defined as transparency $t_{13}$.

The temperature at which the transparency of the recording material becomes $t_{13}$ or more is defined as "transparency temperature" and the temperature interval in which the transparency of the recording material is maintained is defined as "transparency temperature interval", which corresponds to the temperature interval of $T_4$ to $T_5$ in FIG. 2.

The above definitions of the "transparency temperature" and "transparency temperature interval" apply not only the above explained reversible thermosensitive recording material which assumes a transparent state when heated to the first temperature $T_2$, but also to a reversible thermosensitive recording material which assumes a differently colored state when heated to the first temperature $T_2$. In the latter case, the temperature at which the color of the recording material is changed to a different color corresponds to the above "transparency temperature", while the the temperature interval in which the changed colored state is maintained corresponds to the above "transparency temperature interval".

A reversible thermosensitive recording material for use in the present invention can be prepared by applying a reversible thermosensitive recording layer formation liquid on a support, made of, for example, a plastic film, glass plate or metal plate, and drying the coated recording layer.

The reversible thermosensitive recording layer formation liquid can be formed by (1) dissolving a matrix resin and an organic low-molecular-weight material in a solvent, or (2) by dispersing finely-divided particles of at least one organic low-molecular-weight material in a solution of a matrix resin dissolved in a solvent in which at least one of the low-molecular-weight materials is insoluble.

The solvent used for the formation of the thermosensitive recording layer can be selected depending on the kind of matrix resin and organic low-molecular-weight material to be employed. Examples of such a solvent include tetrahydrofuran, methyl ethyl ketone, methyl isobutyl ketone, chloroform, carbon tetrachloride, ethanol, toluene and benzene. Either in the case where the dispersion of a matrix resin and an organic low-molecular weight material is used, or in the case where the solution of the matrix resin and the organic low-molecular weight material is used, the organic low-molecular-weight material is separated in the form of finely-divided particles in the matrix resin, thus present in a dispersed state in the thermosensitive recording layer.

The matrix resin for use in the thermosensitive recording layer serves to maintain the particles of the organic low-molecular-weight material in a uniformly dispersed state in the recording layer and has significant effects on the transparency of the thermosensitive recording layer in a maximum transparent state. Therefore, as such a matrix resin, resins which impart high transparency, high mechanical stability and excellent film-forming properties to the thermosensitive recording layer are preferably employed.

Examples of such resins are polyvinyl chloride; vinyl chloride copolymers such as vinyl chloride—vinyl acetate copolymer, vinyl chloride—vinyl acetate—vinyl alcohol copolymer, and vinyl chloride—vinyl acetate—maleic acid copolymer; vinylidene chloride copolymers such as polyvinylidene chloride, vinylidene chloride—vinyl chloride copolymer, vinylidene chloride—acrylonitrile copolymer, and vinylidene chloride—acrylate copolymer; polyester; polyamide; polyacrylate; polymethacrylate; acrylate—methacrylate copolymer; and silicone resin. These resins can be used alone or in combination.

The organic low-molecular-weight material for use in the reversible thermosensitive recording layer may be appropriately selected from the materials which are changeable from a polycrystalline state to a single crystalline state within the temperature range from $T_1$ to $T_3$ as shown in FIG. 1. It is preferable that the organic low-molecular-weight material for use in the present invention have a melting point ranging from 30 to 200° C., more preferably from about 50 to 150° C.

Examples of such an organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated mono- or di-carboxylic acids, and esters, amides and ammonium salts thereof; saturated or unsaturated halogenated aliphatic acids, and esters, amides and ammonium salts thereof; allylcarboxylic acids, and esters, amides and ammonium salts thereof; halogenated allylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the above-mentioned low-molecular-weight materials have 10 to 60 carbon atoms, more preferably 10 to 38 carbon atoms, and most preferably 10 to 30 carbon atoms. The alcohol-group moieties in these esters may be saturated or unsaturated, and further may be substituted by a halogen. In any case, it is preferable that the organic low-molecular-weight material for use in the recording layer contain a halogen atom or at least one atom selected from the group consisting of oxygen, nitrogen, and sulfur in the form of, for instance, —OH, —COOH, —CONH—, —COOR, —NH—, —$NH_2$, —S—, —S—S—, or —O—.

Specific examples of the above-mentioned organic low-molecular-weight materials include higher fatty acids such as lauric acid, dodecanoic acid, myristic acid, pentadecanoic acid, palmitic acid, heptadecanoic acid, stearic acid, behenic acid, nonadecanoic acid, arachic acid, heneicosanoic acid, tricosanoic acid, lignoceric acid, pentacosanoic acid, cerotic acid, heptacosanoic acid, montanic acid, melissic acid, and oleic acid; esters of higher fatty acids such as methyl stearate, tetradecyl stearate, octadecyl stearate, octadecyl laurate, tetradecyl palmitate and dodecyl behenate; and the following ethers or thioethers:

$C_{16}H_{33}$—O—$C_{16}H_{33}$, $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$, $H_{23}C_{11}OCO{\cdot}H_2C{\cdot}C{\cdot}H_2C$—O—$CH_2{\cdot}CH_2{\cdot}OCOC_{11}H_{23}$, $H_{35}C_{17}OCO{\cdot}H_2C{\cdot}H_2C$—O—$CH_2{\cdot}CH_2{\cdot}OCOC_{17}H_{35}$, $H_3C{\cdot}H_2C{\cdot}(CH_3)HC{\cdot}(CH_2)_{15}OOC{\cdot}H_2C$—O—*

*—$CH_2{\cdot}CH_2{\cdot}COO(CH_2)_{15}{\cdot}CH(CH_3){\cdot}CH_2{\cdot}CH_3$, $H_{25}C_{12}OCO{\cdot}H_2C{\cdot}H_2C$—S—$CH_2{\cdot}CH_2{\cdot}OCOC_{12}H_{25}$, $H_{37}C_{18}OCO{\cdot}H_2C{\cdot}H_2C$—S—$CH_2{\cdot}CH_2{\cdot}OCOC_{18}H_{37}$, $H_3C{\cdot}H_2C{\cdot}(CH_3)HC{\cdot}(CH_2)_{15}OOC{\cdot}H_2C{\cdot}H_2C$—S—**

—$CH_2{\cdot}CH_2{\cdot}COO(CH_2)_{15}{\cdot}CH(CH_3){\cdot}CH_2{\cdot}CH_3$, $H_{37}C_{18}OOC{\cdot}H_2C{\cdot}H_2C$—NH—$CH_2{\cdot}CH_2{\cdot}COOC_{18}H_{37}$, $H_3C{\cdot}H_2C{\cdot}(CH_3)HC{\cdot}(CH_2)_{13}COO{\cdot}H_2C$—NH—*

***—$CH_2{\cdot}COO(CH_2)_{13}{\cdot}CH(CH_3){\cdot}CH_2{\cdot}CH_3$,

Of the above compounds, higher fatty acids having 16 or more carbon atoms are more preferable, and higher fatty acids having 16 to 24 carbon atoms, are most preferable for use in the present invention. Examples of such higher fatty acids are palmitic acid, heptadecanoic acid, nonadecanoic acid, arachic acid, heneicosanoic acid, tricosanoic acid, stearic acid, behenic acid, and lignoceric acid.

The reversible thermosensitive recording material for use in the present invention assumes a first color development state, which may be a transparent state, and a second color development state in different temperature ranges. The temperature interval in which the first color development state is maintained is hereinafter referred to the first temperature interval, and the temperature interval in which the second color development state is maintained is hereinafter referred to the second temperature interval. As a matter of course, the wider the first temperature interval, the easier the reversible thermosensitive recording material assumes the first color development state. However, it is preferable that the first temperature interval be in the range of 15° C. to 80° C., more preferably in the range of 22° C. to 50° C. because when the first temperature interval is larger than the first mentioned range, the lower limit of the second temperature interval is too high to be used in practice, so that the thermal sensitivity of the reversible thermosensitive recording material is too low to be used in practice.

In the case of a reversible thermosensitive recording material comprising an organic low-molecular-weight material and a matrix resin in which the organic low-molecular-weight material is dispersed, the previously mentioned "transparency temperature interval" can be increased either by using a plurality of the previously mentioned organic low-molecular-weight materials in combination, or by using such an organic low-molecular-weight material in combination with another material having a melting point which is different from that of the organic low-molecular-weight material. Such materials are disclosed, for example, in Japanese Laid-Open Patent Applications 63-39378 and 63-130380 and Japanese Patent Applications 63-14754 and 1-140109. However such materials are not limited to those described in these references.

It is preferable that the ratio by weight of the organic low-molecular-weight material to the matrix resin be in the range of about (2:1) to (1:16), more preferably in the range of (1:2) to (1:16) in the reversible thermosensitive recording layer of the reversible thermosensitive recording material. When the ratio of the low-molecular-weight material to the matrix resin is within the above range, the matrix resin can form a reversible thermosensitive recording layer in which the organic low-molecular-weight material is uniformly dispersed in the form of finely-divided particles, and the obtained recording layer can appropriately assume the minimum transparent state and the maximum white opaque state.

Additives such as a high-boiling point solvent, a surface active agent and other additives can be contained in the reversible thermosensitive recording layer to facilitate the formation of transparent images.

Examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethyl butyrate, methyl acetylricinoleate, butyl acetylricinoleate, butylphthalyl butyl glycolate and tributyl acetylcitrate.

Examples of the surface-active agent and other additives are polyhydric alcohol higher fatty acid esters; polyhydric alcohol higher alkyl ethers; lower olefin oxide adducts of polyhydric alcohol higher fatty acid esters, higher alcohols, higher alkylphenols, higher alkylamines of higher fatty acids, amides of higher fatty acids, fats and oils, and polypropylene glycols; acetylene glycol; sodium, calcium, barium and magnesium salts of higher alkyl benzenesulfonic acid; calcium, barium and magnesium salts of higher fatty acids, aromatic carboxylic acids, higher aliphatic sulfonic acids, aromatic sulfonic acids, sulfuric monoesters, phosphoric monoesters and phosphoric diester; lower sulfated oil; poly long-chain alkyl acrylate; acrylic oligomer; poly long-chain alkyl methacrylate; long-chain alkyl methacrylate—amine-containing monomer copolymer; styrene—maleic anhydride copolymer; and olefin—maleic anhydride copolymer.

In the present invention, when the image formed on the reversible thermosensitive recording material is used as a reflection type image, a light reflection layer may be provided behind the recording layer to improve the contrast of the image even if the thickness of the recording layer is made thin. Specifically, the light reflection layer can be prepared by deposition of aluminum, nickel and tin on the support for the recording layer as disclosed in Japanese Laid-Open Patent Application 64-14079.

Further, a protective layer can be formed on the reversible thermosensitive recording layer in order to protect the thermosensitive recording layer. As the material for the protective layer with a thickness of 0.1 to 10 $\mu$m, silicone rubber and silicone resin (as disclosed in Japanese Laid-Open Patent Application 63-221087), polysiloxane graft polymer (as disclosed in Japanese Patent Application 62-152550), and ultraviolet-curing resin and electron radiation curing resin (as disclosed in Japanese Patent Application 63-310600) can be employed. When a protective layer is formed by using any of these materials, the material for the protective layer is dissolved in a solvent to prepare a coating liquid and the thus prepared coating liquid is coated on the thermosensitive recording layer. It is desirable that the solvent be such that the resin and the organic low-molecular-weight material are insoluble or slightly soluble in the solvent.

Examples of the above-mentioned solvent in which the resin and the organic low-molecular-weight material are insoluble or slightly soluble include n-hexane, methyl alcohol, ethyl alcohol and isopropyl alcohol. In particular, alcohol-based solvents are preferred from the viewpoint of the cost.

An intermediate layer can be interposed between the protective layer and the thermosensitive recording layer to protect the thermosensitive recording layer from the solvent or a monomer component for the protective layer formation liquid as disclosed in Japanese Laid-Open Patent Application 1-133781. The intermediate layer can be made of the same resin as employed in the matrix resin for the recording layer. The intermediate layer can also be made of a thermosetting resin or thermoplastic resin such as polyethylene, polypropylene, polystyrene, polyvinyl alcohol, polyvinyl butyral, polyurethane, saturated polyester, unsaturated polyester, epoxy resin, phenolic resin, poly-carbonate and polyamide.

It is preferable that the thickness of the intermediate layer be in the range of about 0.1 to 2 $\mu$m.

Moreover, the reversible thermosensitive recording material can be used as a magnetic card or IC card which is capable of displaying recorded information, when the reversible thermosensitive recording layer is used in combination with a magnetic recording layer or IC.

The image recording method according to the present invention is performed using the above reversible thermosensitive recording materials.

Figure 3:
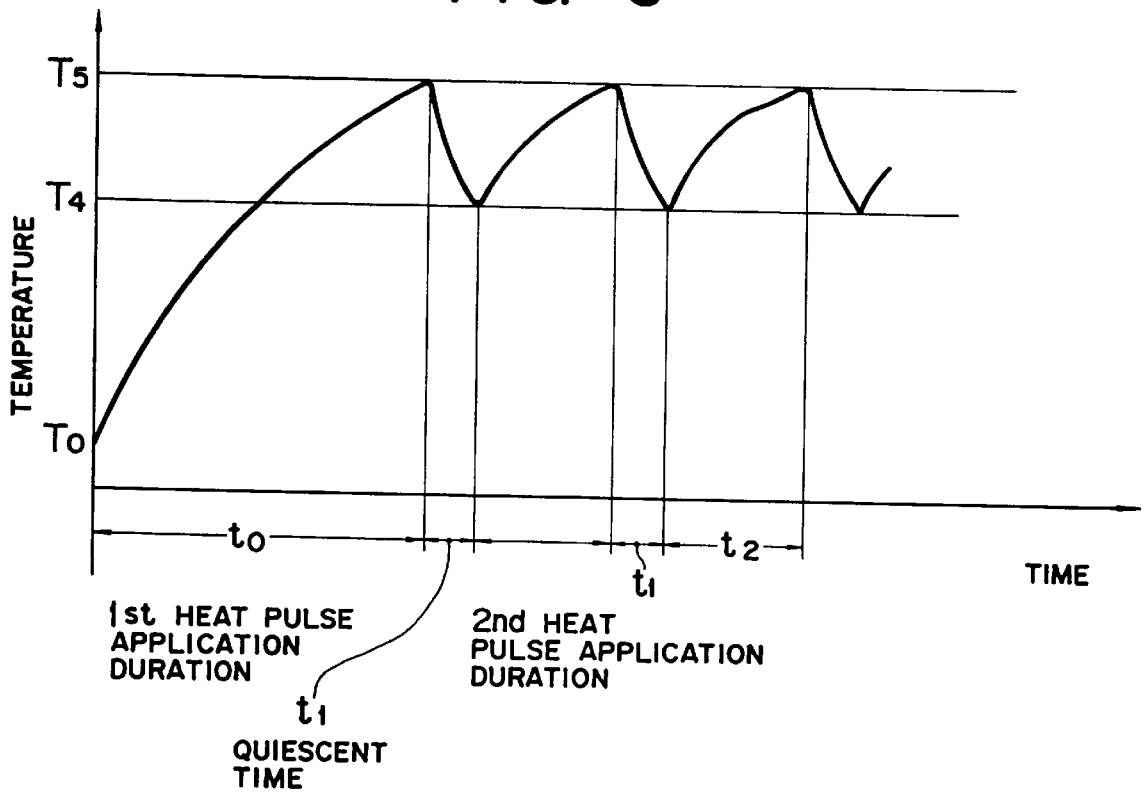
FIG. 3 is a diagram showing an example of the control of the surface temperature of a recording material for use in the present invention, particularly the relationship between the changes in the surface temperature of the recording material and the duration of heat pulse application.

FIG. 3 is a diagram showing an example of the control of the surface temperature of the recording material, particularly the relationship between the changes in the surface temperature of the recording material and the duration of heat pulse application. $T_0$, $T_4$, and $T_5$ respectively represent room temperature (ambient temperature), the lower limit of the previously mentioned transparency temperature interval, and the upper limit thereof shown in FIG. 2. $t_0$ represents a first heat pulse application duration during which thermal energy is applied to the recording layer which is at room temperature until the surface temperature of the recording layer reaches the temperature $T_5$. $t_1$ represents a quiescent time between the first heat pulse and a second heat pulse (or a quiescent time between the second heat pulse and a third heat pulse) during which no thermal energy is applied to the recording layer until the surface temperature of the recording layer decreases to the temperature $T_4$, and $t_2$ represents the second heat pulse application duration or each of the succeeding heat pulse application durations, during which the surface temperature of the recording layer increases to the temperature $T_5$ again.

As long as thermal energy is applied to the reversible thermosensitive recording material for use in the present invention in the thermal energy ON-OFF mode depicted in the diagram in FIG. 3, the recording material can maintain the first color development state in a stable manner.

Figure 4:
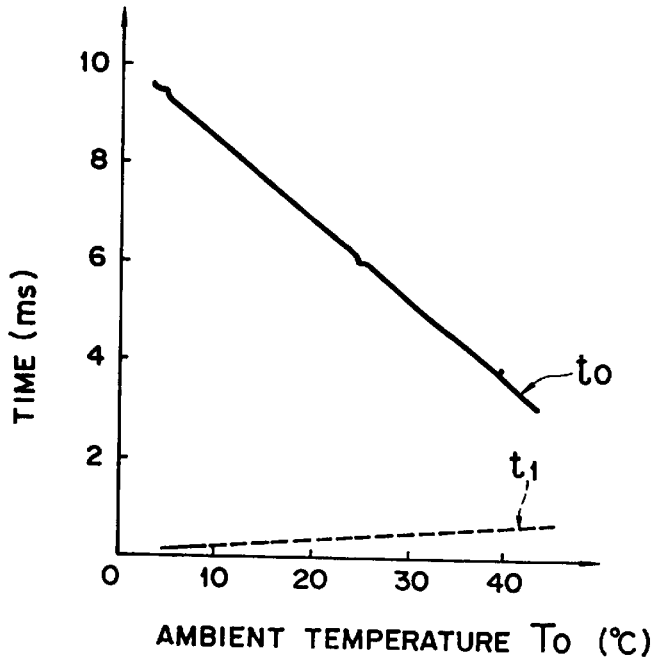
FIG. 4 is a graph showing the relationship between the ambient temperature and a first heat application duration and the relationship between the ambient temperature and a second heat application duration.

The above-mentioned $t_0$, $t_1$ and $t_2$ largely depend on the ambient temperature. FIG. 4 shows the relationship between the ambient temperature $T_0$ and the $t_0$ and $t_1$ when a power of 0.0135 W is applied to a thermal head with 6 dots/mm.

As shown in FIG. 4, the first heat application duration, that is, the temperature rising time $t_0$ decreases almost linearly as the ambient temperature increases, while the quiescent time $t_1$ increases as the ambient temperature increases. The second heat pulse application duration $t_2$ also decreases linearly as the ambient temperature increases in the same manner as in the case of the first heat application duration although this relationship is not depicted in FIG. 4. Therefore the values of $t_0$, $t_1$, and $t_2$ can be determined in accordance with the ambient temperature if the ambient temperature can be measured.

Figure 5:
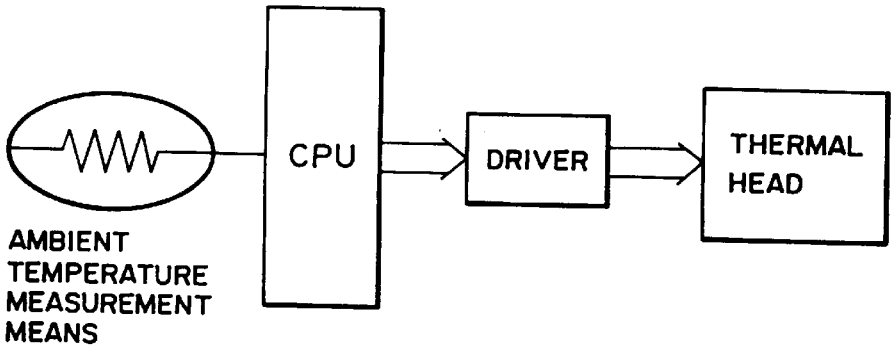
FIG. 5 is a block diagram of an example of a system for the determination of heat pulse application durations in accordance with the ambient temperature.

FIG. 5 shows a block diagram of an example of a system for the determination of the values of $t_0$, $t_1$, and $t_2$ by measuring the ambient temperature. In this system, an ambient temperature measurement means such as a thermistor is provided near a thermal head. The temperature measured by the ambient temperature measurement means is input to an operation device CPU. The relationships between the ambient temperature and the first heat pulse application duration to, the quiescent time $t_1$, and the second heat pulse application duration as shown in FIG. 4 have been stored in advance, so that the appropriate values of $t_0$, $t_1$, and $t_2$ are determined in accordance with the ambient temperature input to the CPU. The thermal head is energized through a driver shown in FIG. 5 in accordance with the determined values of $t_0$, $t_1$, and $t_2$. The measurement of the ambient temperature, and the determination of the values of $t_0$, $t_1$, and $t_2$ may be carried out when a printer for this system is actually energized or immediately before a first image formation is carried out. A pulse-generation timing adjustment means is provided for adjusting a timing of generation of energy pulses for a pulse division means which is provided for dividing energy into the energy pulses to be applied to the thermal head. The pulse-generation timing adjustment means and the pulse division means (not shown) are included as part of the CPU.

In the above-mentioned system, the timings of the application of each heat pulse and the quiescent time are adjusted in accordance with the ambient temperature in order to compensate for the variations in the ambient temperature. The variations in the ambient temperature can also be compensated for by changing the power to be applied to the thermal head.

Figure 6:
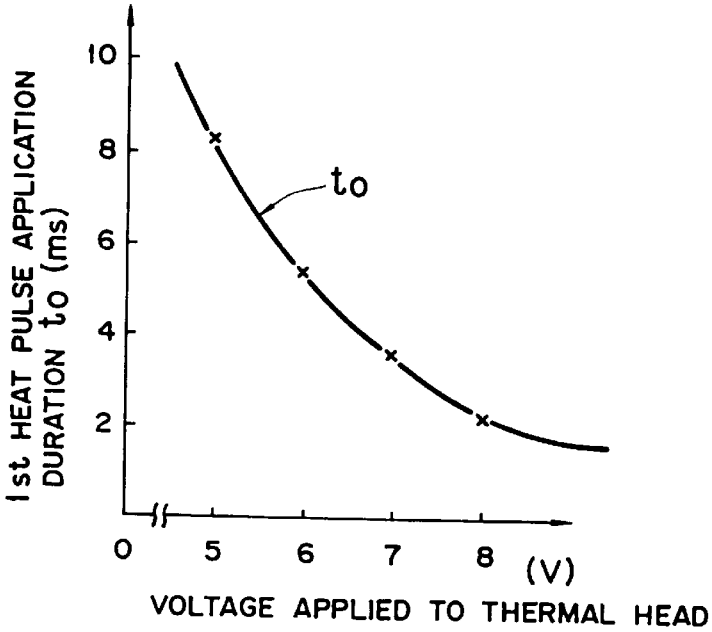
FIG. 6 is a graph showing the relationship between the first heat pulse application duration and the voltage applied to a thermal head.

FIG. 6 is a graph showing the relationship between the voltage applied to a thermal head and the first heat pulse application duration $t_0$. This relationship is similar to the relationship between the voltage applied to the thermal head and the second heat pulse application duration $t_2$ although the latter relationship is not depicted in FIG. 6.

The surface temperature of the recording material can be controlled in the same manner as shown in FIG. 3 by utilizing the relationship shown in FIG. 6 and that shown in FIG. 4. In this case, the timings of the heat pulses for $t_0$ and $t_2$, and the quiescent time $t_1$ are set with the assumption that the ambient temperature is the lowest.

Figure 7:
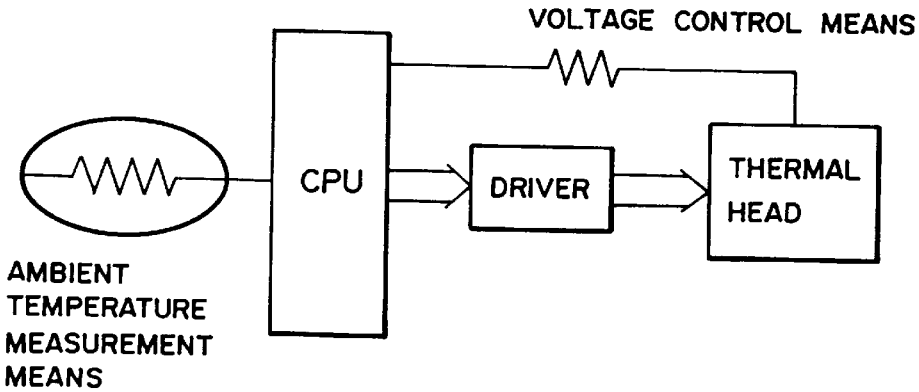
FIG. 7 is a block diagram of another example of a system for the determination of heat pulse application durations in accordance with the ambient temperature.
Figure 8A:
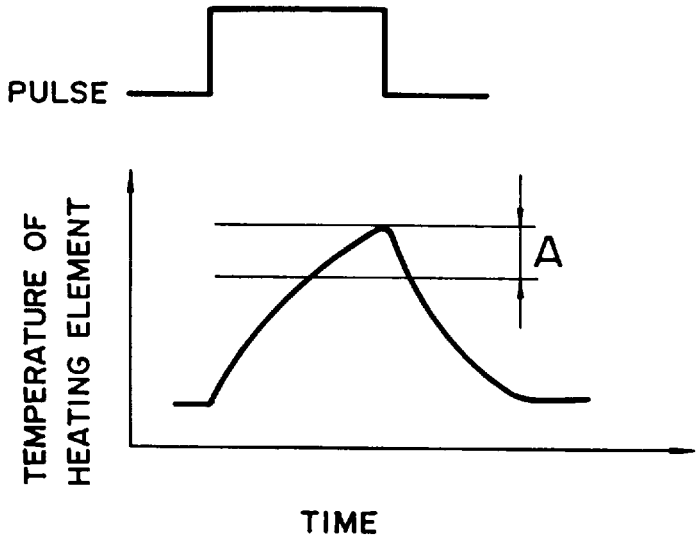
FIGS. 8(*a*) to 8(*d*) are the diagrams in explanation of an example of an image recording method according to the present invention.
Figure 8B:
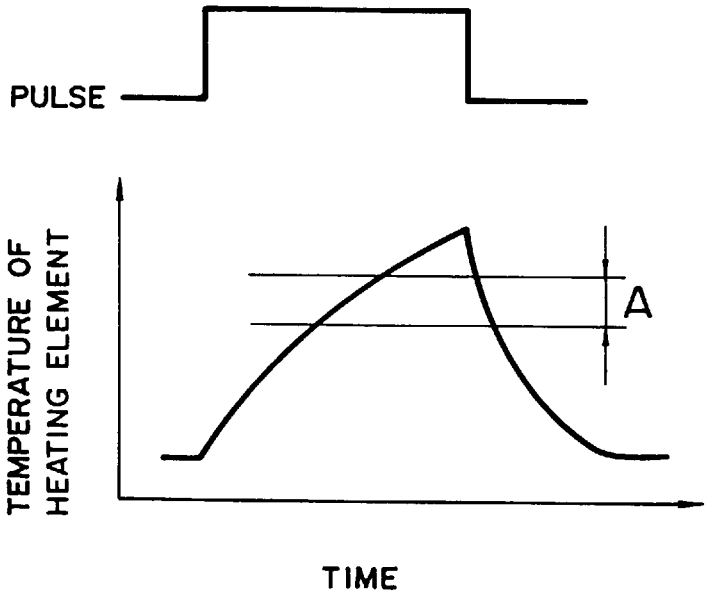
Figure 8C:
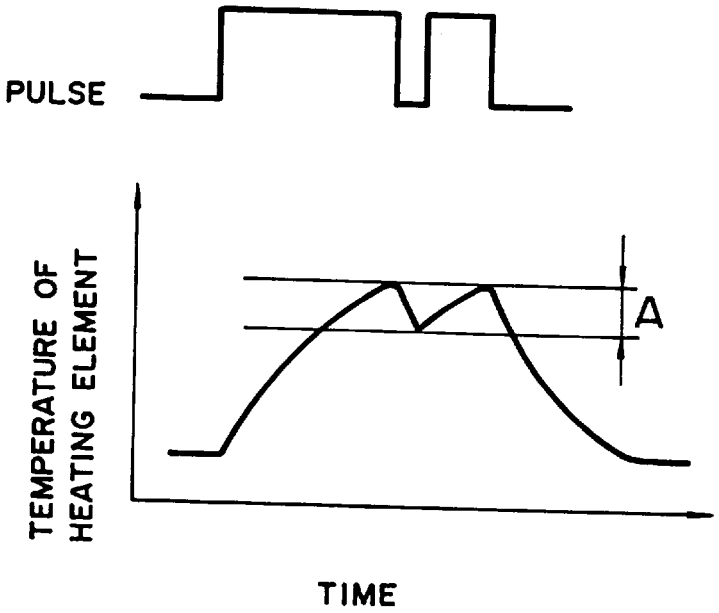
Figure 8D:
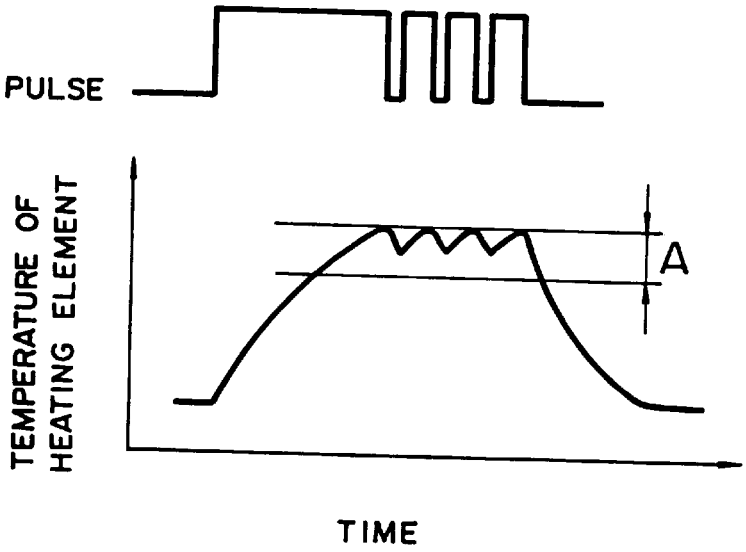

FIG. 7 shows a block diagram of a specific example of the above-mentioned system. In this system, an appropriate voltage or power to be applied to the thermal head is determined in accordance with the measured ambient temperature in the above-mentioned manner. Signals for indicating the heat pulses to be applied are input to the thermal head with predetermined timings, and at the same time, the appropriate voltage or power is applied to the thermal head through a voltage control means.

Also in this case, the measurement of the ambient temperature, and the determination of the values of $t_0$, $t_1$, and $t_2$ may be carried out when a printer for this system is actually energized or immediately before a first image formation is carried out.

It can be said that the operation modes for the image recording method according to the present invention can be roughly classified into two when viewed from the relative positional relationship between a heating element such as the above-mentioned thermal head and the reversible thermosensitive recording material for use in the present invention.

In one mode, the relative positional relationship between the heating element and the recording material is not changed, while in the other method, the relative positional relationship between the two is changed, that is, one is moved relative to the other.

The mode in which the relative positional relationship between the heating element and the recording material is not changed will now be explained with reference to FIGS. 8(*a*) through 8(*d*).

FIG. 8(*a*) shows the changes in the temperature of a heating element with time when heated with the application of a single heat pulse thereto.

FIG. 8(*b*) shows the changes in the temperature of a heating element with time when heated with the application of a single heat pulse thereto which has a longer duration than the heat pulse shown in FIG. 8(*a*).

FIG. 8(*c*) shows the changes in the temperature of a heating element with time when heated with the application of two heat pulses thereto.

In these figures, the first temperature range in which the first color development state is maintained is also indicated by A.

In the case of FIG. 8(*a*), the temperature of the heating element reaches the first temperature range A at the final moment of the duration of the application of the heat pulse. When the duration of the application of the heat pulse is lengthened, the temperature of the heating element exceeds the first temperature range A as shown in FIG. 8(*b*). In contrast with the above, when two heat pulses are successively applied to the heating element, the first temperature range A can be maintained for a longer period of time as shown in FIG. 8(*c*) in comparison with the case shown in FIG. 8(*a*). This is because the heating element is heated once and then heated once again after cooling for a short period of time. Therefore, the first color development state can be obtained in a stable manner more easily in the case of FIG. 8(*c*) in comparison with the cases of FIG. 8(*a*) and FIG. 8(*b*).

FIG. 8(*d*) shows the case where the number of the heat pulses to be applied is further increased to 4 heat pulses. FIG. 8(*d*) indicates that the dispersion of the temperature of the heating element at the application of the heat pulses can be decreased, so that even when the first temperature interval for maintaining the first color development state of the recording material is narrow, a uniform transparency or colored state can be obtained.

When a single heat pulse is applied to the heating element for producing a second color development state in the recording material, the temperature of the heating element reaches the second temperature range for maintaining the second color development state at the final moment of the duration of the application of the heat pulse in the same manner as shown in FIG. 8(*a*). Furthermore, when heat pulses are continuously applied in order to lengthen the duration of the application of thermal energy, the duration in which the temperature of the heating element is raised above the second temperature range can be in fact lengthened. However, the temperature is raised so excessively that the recording material is caused to deteriorate or the surface thereof is scratched by the thermal head.

In sharp contrast to the above, when a plurality of heat pulses is applied to the heating element for producing the second color development state in the recording material, the excessive temperature elevation above the second temperature range and the duration thereof can be minimized, so that the second color development state can be obtained in a uniform state, and the deterioration of the recording layer and the formation of scratches on the surface thereof can be minimized and the life of the recording material can be lengthened even when used repeatedly.

The width of the heat pulse is preferably in the range of about 0.05 msec to 30 msec, more preferably in the range of 0.1 msec to 5 msec.

The mode in which the relative positional relationship between the heating element and the recording material is changed will now be explained with reference to FIGS. 9(*a*), 9(*b*-1), 9(*b*-2), 9(*c*-1) and 9(*c*-2).

Figure 9A:
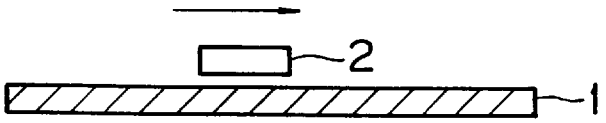
FIGS. 9(*a*) to 9(*c*-2) are the diagrams in explanation of another example of the image recording method according to the present invention.
Figure 9A:
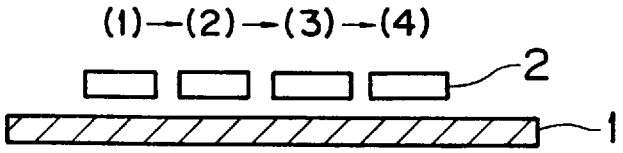
Figure 9A:
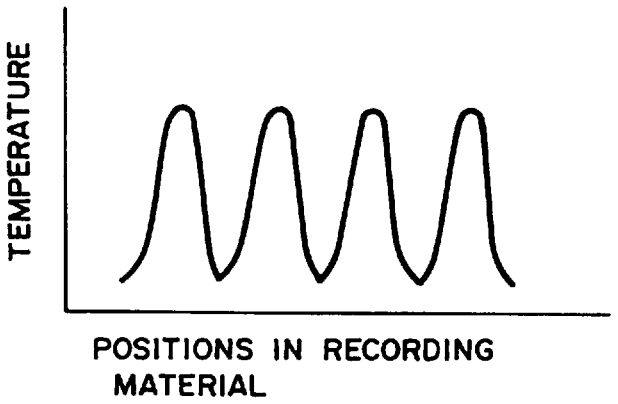

FIG. 9(*a*) shows the state where a heating element 2 such as a thermal head is moved relative to a recording material 1 in the direction of the arrow.

FIG. 9(*b*-1) shows that the heating element 2 is moved in the direction of the successive arrows as the heating element 2 is heated successively in such a mode that the movement distance of the heating element 2 during the period in which the heating element 2 has been energized to be heated, deenergized and is then energized once again is longer than or equal to the length of the heating element 2. In this figure, reference numerals (1), (2), (3) and (4) indicate the successive positions of the heating element 2 in the course of the movement thereof at which the heating element 2 is heated. FIG. 9(*b*-2) shows the temperature distribution on the surface of the recording material, indicating that the temperature differences on the surface of the recording material are large.

FIG. 9(*c*-1) shows that the heating element 2 is moved in the direction of the successive arrows as the heating element 2 is heated successively in such a mode that the movement distance of the heating element 2 during the period in which the heating element 2 has been energized to be heated, deenergized and is then energized once again is shorter than the length of the heating element 2. In this figure, reference numerals (1), (2), (3), (4), (5), (6) and (7) indicate the successive positions of the heating element 2 in the course of the movement thereof at which the heating element 2 is heated. In this case, the instant position of the heating element 2 and the previous position thereof partly overlap. Therefore as shown by the solid curve in FIG. 9(*c*-2), the temperature distribution on the surface of the recording material is relatively uniform, so that even when the first temperature interval for maintaining the first color development state of the recording material is narrow, a uniform transparency or colored state can be obtained.

By the above-mentioned method, the second color development state can also be obtained in a uniform state, with the deterioration of the recording layer and the formation of scratches on the surface thereof being minimized and the life of the recording material being maximized even when used repeatedly.

FIGS. 9(*a*), 9(*b*-1), 9(*b*-2), 9(*c*-1) and 9(*c*-2) do not show the case where the recording material 1 is moved, while the heating element 2 is moved. However, the same explanation as made above also applies to this case since this case and the above-mentioned case are essentially the same in the sense that one is moved relative to the other and this can be accomplished by use of, for example, a step motor. Furthermore, in these figures, when the heating element 2 is heated, it is stationary with respect to the recording material 1. However, the above explanation also applies to the case where one of the heating element 2 or the recording material 1 is continuously moved relative to the other.

It is preferable that the relative movement distance between the heating element and the recording material be in the range of 1/10 to 9/10 of the length of the heating element, more preferably in the range of 1/5 to 4/5 during the period from the completion of the application of the heat pulse to the heating element through the initiation of the next application of the heat pulse.

The method of applying a plurality of energy pulses to the heating element can be employed for heating the recording material to either a first temperature or a second temperature or both temperatures. For example, it is possible to apply a plurality of energy pulses to the heating element to raise the temperature thereof to the first temperature and to apply a single energy pulse to the heating element to raise the temperature to the second temperature, or to apply thermal energy to the heating element to raise the temperature thereof to the second temperature by a heat roller or a heat plate.

Other features of this invention will become apparent in the course of the following description of exemplary embodiments which are given for illustration of the invention and are not intended to be limiting thereof.

Example 1

[Formation of Light Reflection Layer]

An aluminum layer with a thickness of about 400 serving as a light reflection layer was formed by vacuum deposition on a polyester film with a thickness of about 50

[Formation of Reversible Thermosensitive Recording Layer]

The following components were mixed to prepare a coating liquid for the formation of a reversible thermosensitive recording layer:

| | Parts by Weight |
|---|---|
| Behenic acid (Trademark "NAA-22S" made by Nippon Oil & Fats Co., Ltd.) | 6 |
| Eicosanedioic acid (Trademark "SL-20" made by Okamura Oil Mill Ltd.) | 4 |
| Diallyl phthalate | 2 |
| Vinyl chloride - vinyl acetate - phosphoric ester copolymer (Trademark "Denka Vinyl #1000P" made by Denki Kagaku Kogyo K.K.) | 20 |
| Tetrahydrofuran | 150 |

The thus obtained coating liquid was coated on the above formed light reflection layer by a wire bar and dried, so that a reversible thermosensitive recording layer having a thickness of about 6 $\mu$m was formed on the light reflection layer.

[Formation of Intermediate Layer]

The following components were mixed to prepare a coating liquid for the formation of an intermediate layer:

| | Parts by Weight |
|---|---|
| Polyamide resin (Trademark "CM8000" made by Toray Industries, Inc.) | 10 |
| Ethyl alcohol | 90 |

The thus obtained coating liquid was coated on the above formed reversible thermosensitive recording layer and dried under application of heat thereto, so that an intermediate layer with a thickness of about 0.5 $\mu$m was formed on the reversible thermosensitive recording layer.

[Formation of Protective Layer]

The following components were mixed to prepare a coating liquid for the formation of a protective layer:

| | Parts by Weight |
|---|---|
| 75% butyl acetate solution of urethane-acrylate ultraviolet-curing resin (Trademark "Unidic 17-824-9" made by Dainippon Ink & Chemicals, Incorporated) | 10 |
| Toluene | 10 |

The thus obtained coating liquid was coated on the above formed intermediate layer, dried under application of heat thereto, and the coated surface was exposed to ultraviolet light for 5 seconds using an ultraviolet lamp of 80 W/cm, so that a protective layer with a thickness of about 2 $\mu$m was formed.

Thus, a reversible thermosensitive recording material for use in the present invention in a milky white opaque state was obtained. The transparency temperature interval of the above recording material was 25° C.

The reversible thermosensitive recording material obtained in Example 1 was heated to 80° C., so that the recording material assumed a transparent state in its entirety. Then, the transparent state of the recording material was changed into a milky white opaque state with the application of heat thereto using a thermal head (Trademark "Model SH-216-08PC31" made by Ricoh Company Ltd.) under the following conditions:

Applied pulse width: 1.0 msec.

Applied energy: 0.4 mJ/dot

The above recording material was heated by the thermal head with the ambient temperature being measured and the timing of the heat pulses being adjusted by the system shown in FIG. 5, and a first heat pulse with a pulse width of 3 msec was applied to the recording material, followed by a quiescent time of 0.5 msec, and then a second heat pulse with a pulse width of 1 msec was applied thereto, so that a transparent image was formed.

The reflection density of the transparent image measured by Macbeth densitometer RD-514 was 1.65.

For comparison, the same recording material as employed in Example 1 was once heated with a heat pulse with a pulse width of 3 msec to form a transparent image and the reflection density thereof measured 1.14.

Example 2

[Formation of Magnetic Recording Layer]

The following components were mixed to prepare a coating liquid:

| | Parts by Weight |
|---|---|
| $\gamma$-$Fe_2O_3$ | 10 |
| Vinyl chloride - vinyl acetate - vinyl alcohol copolymer (Trademark "VAGH" made by Union Carbide Japan K.K.) | 2 |
| 10% toluene solution of "Coronate L" (Trademark) (made by Nippon Polyurethane Industry Co., Ltd.) | 2 |
| Methyl ethyl ketone | 43 |
| Toluene | 43 |

The above prepared coating liquid was coated on a white PET (polyethylene terephthalate) film having a thickness of about 188 $\mu$m, serving as a support, by a wire bar, so that a magnetic recording layer with a thickness of about 10 μm was formed on the support. The surface of the magnetic recording layer was subjected to calendering to improve the surface smoothness.

[Formation of Light Reflection Layer]

Al was deposited on the above magnetic recording layer in vacuum to form a light reflection layer with a thickness of about 400 Å.

[Formation of Reversible Thermosensitive Recording Layer]

The following components were mixed to prepare a coating liquid for the formation of a reversible thermosensitive recording layer:

| | Parts by Weight |
|---|---|
| Behenic acid (Trademark "NAA-22S" made by Nippon Oil & Fats Co., Ltd.) | 7 |
| Eicosanedioic acid (Trademark "SL-20" made by Okamura Oil Mill Ltd.) | 3 |
| Diallyl phthalate | 2 |
| Vinyl chloride - vinyl acetate-phosphoric ester copolymer (Trademark "Denka Vinyl #1000P" made by Denki Kagaku Kogyo K.K.) | 20 |
| Tetrahydrofuran | 150 |

The thus obtained coating liquid was coated on the above formed light reflection layer by a wire bar and dried, so that a reversible thermosensitive recording layer having a thickness of about 6 μm was formed on the light reflection layer.

On the above reversible thermosensitive recording layer, the same intermediate layer and protective layer as those employed in Example 1 were successively formed, whereby a magnetic card shaped reversible thermosensitive recording material was fabricated.

The thus obtained reversible thermosensitive recording material was in a milky white state and the transparency temperature interval was 17° C.

The above recording material was heated by a thermal head with the ambient temperature being measured and the timing of the heat pulses being adjusted by the system shown in FIG. 7, and a first heat pulse with a pulse width of 8 msec was applied to the recording material, followed by a quiescent time of 1 msec, and then a second heat pulse with a pulse width of 1 msec was applied thereto, so that a transparent image was formed.

The reflection density of the transparent image measured by Macbeth densitometer RD-514 was 1.48.

For comparison, the same recording material as employed in Example 3 was once heated with a heat pulse with a pulse width of 8 msec to form a transparent image and the reflection density thereof measured 1.07.

Example 3

Figure 10:
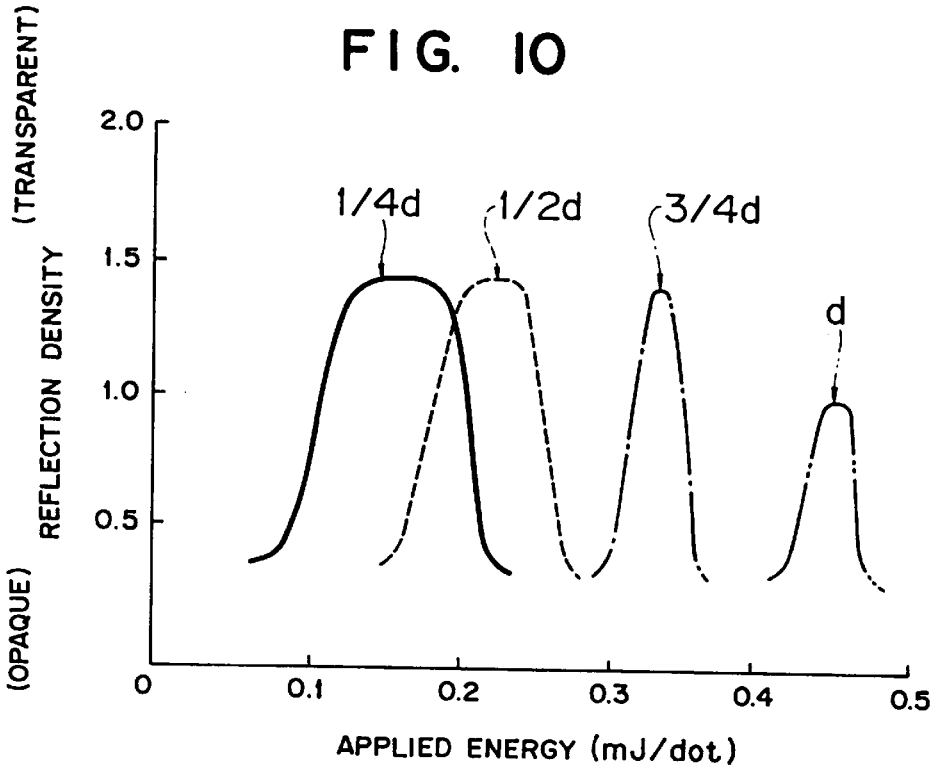
FIG. 10 is a graph showing the relationship between the reflection densities of images formed by a heating element and the energy applied to the heating element obtained in Example 3.

The recording material employed in Example 1 was subjected to an image formation test by the application of energy pulses with a pulse width of 3 msec, with the applied energy changed as shown in FIG. 10, as the relative distance between the heating element having a length of d in the moving direction thereof and the recording material was changed to ¼d, ½d, ¾d, and d. The reflection densities of the thus obtained transparent images were measured by Macbeth densitometer RD-514. The results are shown in FIG. 10.

Example 4

Figure 11:
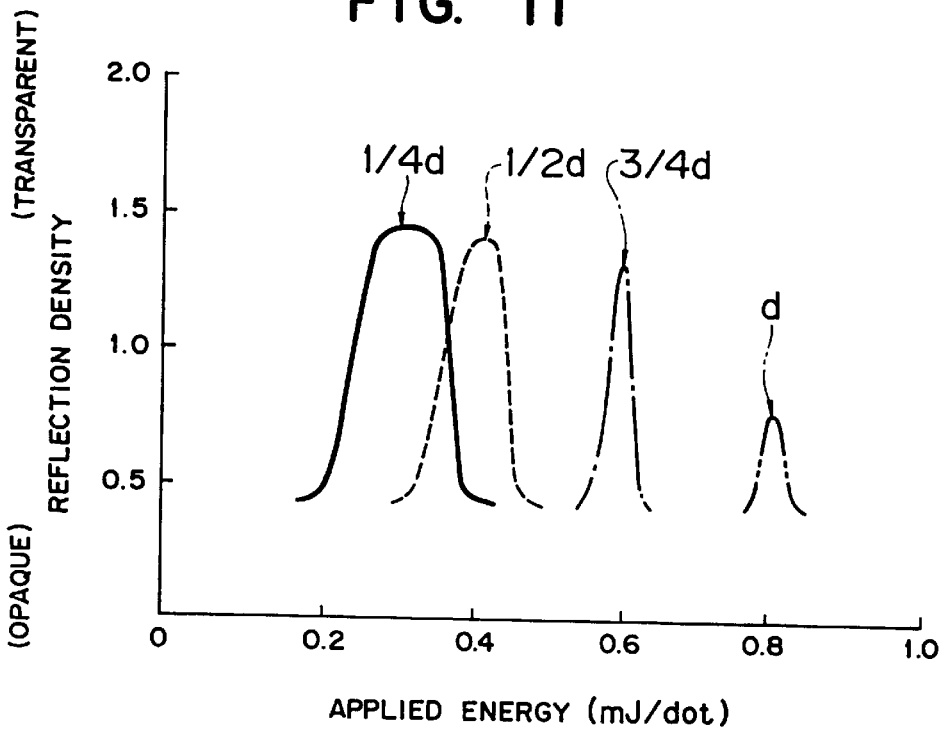
FIG. 11 is a graph showing the relationship between the reflection densities of images formed by a heating element and the energy applied to the heating element obtained in Example 4.

The recording material employed in Example 2 was subjected to an image formation test by the application of energy pulses with a pulse width of 8 msec, with the applied energy changed as shown in FIG. 11, as the relative distance between the heating element having a length of d in the moving direction thereof and the recording material was changed to ¼d, ½d, ¾d, and d. The reflection densities of the thus obtained transparent images were measured by Macbeth densitometer RD-514. The results are shown in FIG. 11.

Example 5

The same recording material as employed in Example 1 was heated by the same thermal head as employed in Example 1 with the ambient temperature being measured and the timing of the heat pulses being adjusted by the system shown in FIG. 5, and a first heat pulse with a pulse width of 0.7 msec was applied to the recording material, followed by a quiescent time of 0.2 msec, and then a second heat pulse with a pulse width of 0.3 msec was applied thereto, so that a thermal energy of 0.4 mJ/dot in total was applied to the recording material, whereby a milky white opaque image was formed on the recording material. The thus formed milky white opaque image was heated by a heat roller which was heated to 90° C., whereby the milky white opaque image was made transparent to form a transparent image. This cycle of the formation of the milky white opaque image and the transparent image was repeated 100 times.

The density of the 1st milky white image measured by Macbeth densitometer RD-914 was 0.48, while the density of the 100th milky white image was 0.52.

For comparison, the same recording material as employed in the above was once heated with a heat pulse with a pulse width of 1.0 msec, with the application of a thermal energy of 0.4 mJ/dot, to form a milky white image. The thus formed milky white image was made transparent by the application of heat using the above-mentioned heat roller. This cycle of the formation of the milky white opaque image and the transparent image was repeated 100 times.

The density of the 1st milky white image measured by Macbeth densitometer RD-914 was 0.47, while the density of the 100th milky white image was 0.75. This indicates that the density of the milky white image was caused to significantly deteriorate.

Example 6

The recording material employed in Example 1 was subjected to an image formation test by the application of an energy pulse of 0.3 mJ/dot with a pulse width of 3 msec, and with the relative moving distance between the heating element having a length of d in the moving direction thereof and the recording material being set at ½d during the period from the completion of the application of one pulse through the initiation of the succeeding pulse, whereby a milky white opaque image was formed.

The thus formed milky white opaque image was heated by a heat roller which was heated to 90° C., whereby the milky white opaque image was made transparent to form a transparent image. This cycle of the formation of the milky white opaque image and the transparent image was repeated 100 times.

The density of the 1st milky white image measured by Macbeth densitometer RD-914 was 0.46, while the density of the 100th milky white image was 0.50.

For comparison, the above image formation cycle was repeated except that the relative moving distance between the heating element and the recording material was set at d, and the energy of the applied pulse was set at 0.5 mJ/dot, whereby a milky white opaque image was formed.

The thus formed milky white opaque image was heated by a heat roller which was heated to 90° C., whereby the milky white opaque image was made transparent to form a transparent image. This cycle of the formation of the milky white opaque image and the transparent image was repeated 100 times.

The density of the 1st milky white image measured by Macbeth densitometer RD-914 was 0.48, while the density of the 100th milky white image was 0.78. Thus, the density of the milky white image was significantly degraded.

What is claimed is:

1. An image recording apparatus comprising:

a reversible thermal sensitive recording material;

a heating element for generating heat to form a plurality of picture elements of an image to be formed in said recording material by applying a plurality of generated energy pulses to said heating element;

a pulse division means for dividing energy to be applied to said heating element into said plurality of energy pulses;

an ambient temperature measurement means for measuring an ambient temperature of said recording material;

a pulse-generation timing adjustment means coupled between said pulse division means and said ambient temperature measurement means for adjusting a timing of generation of said plurality of energy pulses wherein said recording material assumes a first colored state when heated to a first temperature which is above room temperature, said recording material stably maintains said first colored state during a predetermined time period when a predetermined first colored state temperature range is maintained, and said recording material assumes a second colored state when said recording material is first heated to a second temperature, which is greater than said first temperature, and said recording material is subsequently cooled down from said second temperature, wherein:

said pulse-generation timing adjustment means adjusts the timing for generation of said plurality of energy pulses in accordance with said ambient temperature.

2. An image recording method using a reversible thermal sensitive recording material and a heating element, said method comprising the steps of:

applying energy to said heating element for generating heat in such a manner as to form each picture element of an image in a recording material through the application of a plurality of generated energy pulses;

measuring the ambient temperature of said recording material;

adjusting a timing of generation of said plurality of energy pulses wherein said recording material assumes a first colored state when heated to a first temperature which is above room temperature, said recording material stably maintains said first colored state during a predetermined time period when a predetermined first colored state temperature range is maintained, and said recording material assumes a second colored state when said recording material is first heated to a second temperature, which is greater than said first temperature, and said recording material is subsequently cooled down from said second temperature; and adjusting the timing of generation of said plurality of energy pulses in accordance with said ambient temperature.

* * * * *